United States Patent [19]

McDowell et al.

[11] Patent Number: 4,588,242

[45] Date of Patent: May 13, 1986

[54] SEALED ELECTRICAL CONNECTOR

[75] Inventors: Paul W. McDowell, Mechanicsburg; Wilfred R. Scheller, Camp Hill, both of Pa.

[73] Assignee: AMP Incorporated, Harrisburg, Pa.

[21] Appl. No.: 511,079

[22] Filed: Jul. 6, 1983

[51] Int. Cl.[4] ..... H01R 11/00

[52] U.S. Cl. ..... 339/59 M; 339/60 M; 339/94 M; 339/217 S; 339/126 RS

[58] Field of Search ..... 339/94, 59, 60, 61, 339/217 S, 218 R, 218 M, 126 RS, 176 MP

[56] References Cited

U.S. PATENT DOCUMENTS

| | | | |
|---|---|---|---|
| 2,881,406 | 4/1959 | Arson | 339/94 M |
| 3,068,443 | 12/1962 | Nava et al. | 339/217 |
| 3,120,987 | 2/1964 | Degnan et al. | 339/60 M |
| 3,221,292 | 11/1965 | Swanson et al. | 339/217 |
| 3,707,696 | 12/1972 | Carter | 339/17 F |
| 3,721,943 | 3/1973 | Curr | 339/218 M |
| 3,840,841 | 10/1974 | Clark | 339/217 S |
| 3,941,444 | 3/1976 | Bruni et al. | 339/94 M |
| 3,970,352 | 7/1976 | Dorrell et al. | 339/94 M |
| 4,084,872 | 4/1978 | Pritulsky | 339/217 S |
| 4,146,286 | 3/1979 | Jones | 339/61 R |
| 4,173,349 | 11/1979 | Neale | 277/6 |
| 4,270,825 | 6/1981 | Marsh | 339/217 S |
| 4,312,553 | 1/1982 | Lyckesjo | 339/94 M |
| 4,323,296 | 4/1982 | Andoh | 339/217 S |
| 4,343,523 | 10/1982 | Cairnset et al. | 339/176 MP |
| 4,387,944 | 6/1983 | Frear | 339/59 R |
| 4,479,691 | 10/1984 | Smith, Jr. | 339/59 M |

FOREIGN PATENT DOCUMENTS

| | | | |
|---|---|---|---|
| 1590478 | 6/1981 | United Kingdom | 339/94 A |

*Primary Examiner*—Gil Weidenfeld
*Assistant Examiner*—David L. Pirlot
*Attorney, Agent, or Firm*—Robert W. J. Usher

[57] ABSTRACT

An electrical connector in which an elastomeric seal is moulded in a rear, wire receiving face of a rigid housing shell to seal wires terminated in passageways in the connector. The seal preferably has a front facing portion surrounding the passageways to seal a mating interface. Resilient terminal latching fingers provided in a wall of each passageway flex out of the housing profile to admit the terminal and a mould core and prevent connector mating prior to complete insertion of all terminals in the passageways.

5 Claims, 11 Drawing Figures

FIG 6

43
42
37
45
12
41
13
51
15
47
29
30
18
32
24
29
17
27
34
66
68
14
22
67
33
54
54'
27'
32'
30'
29'
24'
48
48'
47'
21
19
17'
29'
52
53
64
70
33'
32'
11
35
39
65
66
62
64
14
65
61
63
22
12
36
22'
35
39
37
42

SEALED ELECTRICAL CONNECTOR

The invention relates to sealed electrical connectors and to housings for such connectors.

A requirement for electrical connectors sealed against ingress of moisture has been present for many years, particularly where the connector is to be used in an adverse environment such as in a road vehicle. At the same time, in the interests of economy and reliability, the connectors should have few separate parts and be capable of manufacture by mass production techniques. It is also desirable that individual terminals of the connector can be replaced without a requirement for special extraction tools and without destruction of the sealing.

Examples of prior sealed electric connectors in which seal members are mounted on a wire receiving face of an electrical connector housing are described in U.S. Pat. No. 3,941,444 and U.S. Pat. No. 4,150,866. However, in both prior connectors, the terminals must be inserted through wire receiving passageways in the seal members themselves which tends to scarify the seal members with destruction of the effectiveness of the sealing. Furthermore, the individual sealing members require handling and are prone to dislodgement in the field.

U.S. Pat. No. 4,105,278 and UK 2,078,020A describe electrical connectors in which housings are moulded on preformed pads of insulating material clamped or otherwise mounted on a cable and insulated wires respectively. Neither of these constructions readily permit the removal for replacement of individual terminals from the housings.

According to one aspect of the invention, there is provided an electrical connector housing comprising a shell defining walls of terminal-receiving passageways communicating with a rear, wire receiving face and a front, mating face of the housing and an elastomeric seal moulded in a rear portion of the shell to provide wire receiving extensions of the passageways of restricted size for sealing engagement with the wires.

The seal, formed by a second stage moulding process, is therefore permanently fixed in the housing shell also providing a requirement for an assembly procedure even if individual terminals in the connectors are replaced. Free ends of individual insulated wires can be threaded through the rear face of the housing to protrude from the mating face where they are terminated and withdrawn into the passageways.

Preferably, the shell has a peripheral flange extending transversely of the rear portion and formed with a cavity opening to the mating face, in which cavity elastomeric material is moulded to provide a seal surrounding the passageways. Desirably, the cavity and the rear portion are intercommunicating, the elastomeric material constituting a unitary sealing member.

Thus, in a single shot, moulding seals are provided both for the wires at a rear, wire receiving face and for abutment with either a mating connector or a panel thereby completely to seal the mating interface.

Desirably, the outer walls of the passageways are formed with resilient, axially extending, terminal latching fingers having free front ends and rearwardly facing terminal abutting shoulders for retention of the terminals in the passageways, the fingers being flexible beyond the profile of the housing to admit terminals into the passageways.

This construction both provides terminal retention on withdrawing the terminal wires into the passageways and will cooperate with a suitably configured mould core member to enable entry and withdrawal of the core member axially from the housing passageways, permitting a relatively simple straight draw mould to be used for the second stage moulding of the seal. Protrusion of the fingers beyond the housing profile will also prevent mating of the connector prior to complete insertion of the terminals in the passageways.

The invention includes an electrical connector including a composite housing comprising a shell defining walls of terminal-receiving passageways communicating with a rear, wire receiving face and a front, mating face and an elastomeric seal moulded in a rear portion of the shell to provide wire receiving extensions of the passageways of restricted size for sealing engagement with the wires.

An example of a printed circuit board edge connector according to the invention will now be described with reference to the accompanying drawings in which:

FIG. 3 is a view similar to FIG. 2A during insertion of the moulded parts into the housing shell;

Figures 1A, 2B:
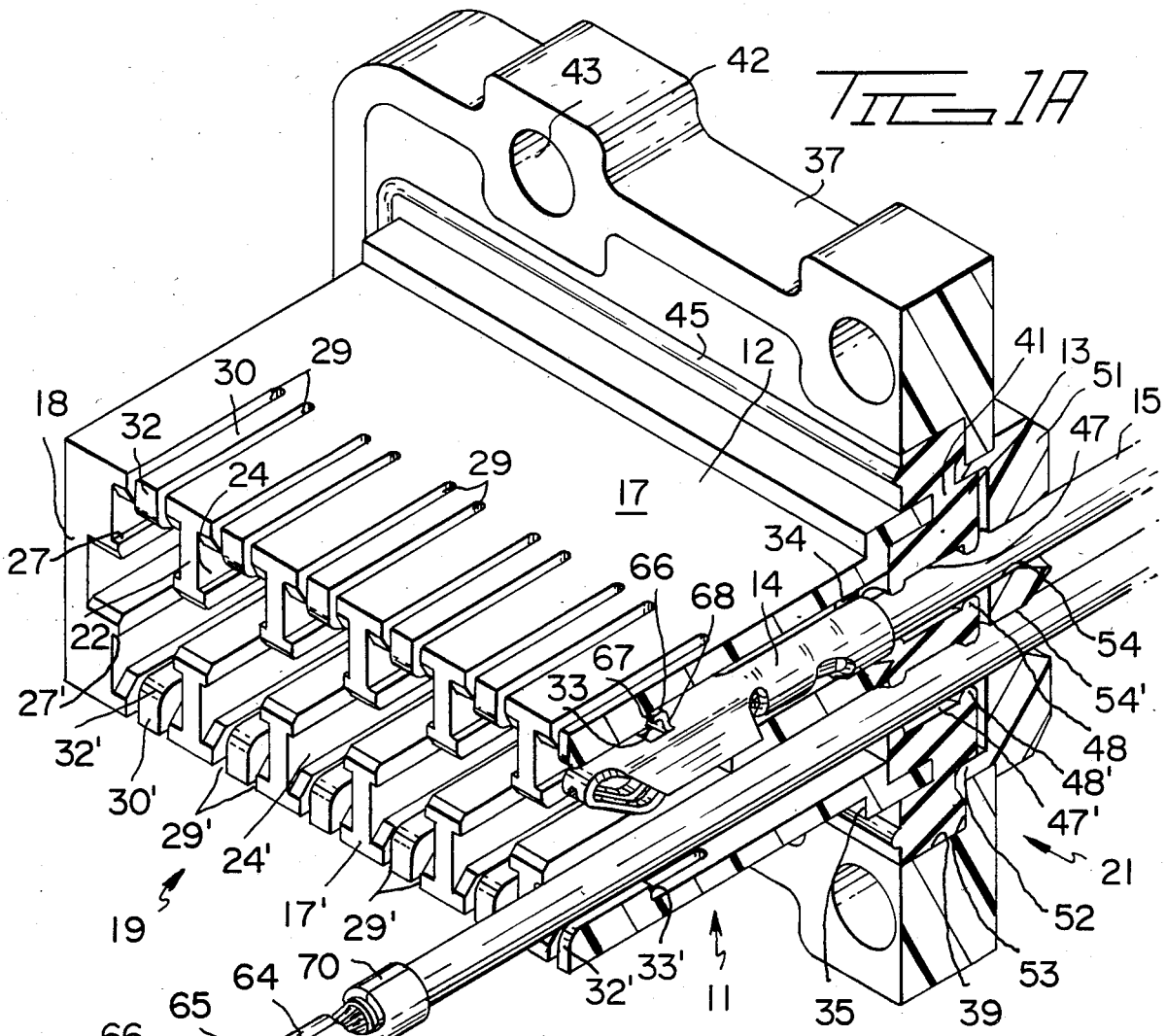
FIG. 1A is an isometric view, partly in cross-section of the connector with terminated wires partly assembled therewith.
FIG. 2B is a cross-sectional view of the connector housing shell taken along line IIB—IIB in FIG. 1A.
Figure 1B:
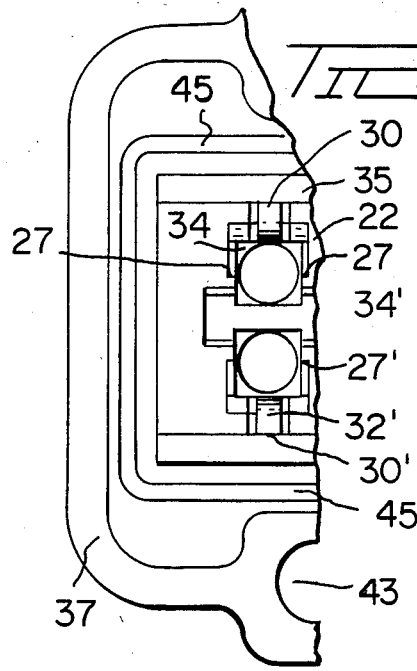
FIG. 1B is a fragmentary front elevation of the connector.

As shown most clearly in FIG. 1A and FIG. 1B, the electrical connector 11 comprises a housing shell 12 moulded from relatively rigid plastics material in which is moulded a seal of elastomeric material 13. A series of terminals 14 terminating respective insulated wires 15 are located in two rows in the housing to receive between them a printed circuit board (not shown).

The housing shell 12 is of substantially rectangular transverse cross-section having opposed side walls 17, 17' and end walls 18, 18' extending between a front-mating face 19, and a rear wire receiving face 21. T-section barriers 22, 22' extend from the side walls 17, 17' to define between them two rows of opposed terminal-receiving passageways 24, 24' open along inner faces 25, 25' remote from their associated walls 17 or 17' and communicating with mating and wire-receiving faces, the cross of the T defining terminal supporting ledges 27, 27' along inner faces of respective passageways. Pairs of spaced slots 29, 29' are formed in the side walls 17, 17' to extend rearwardly from the mating face 18, the slots of each pair defining between them resilient terminal latching fingers 30, 30' having free front ends formed with inwardly facing camming noses 32, 32' and rearwardly facing terminal retention shoulders 33, 33'. Each slot also defines a second series of terminal supporting ledges 27, 27' in the walls 17, 17' respectively. The terminal-receiving passageways 24, 24' terminate at annular constrictions 34, 34' defining terminal back stops. Rearwardly of the constrictions, the housing shell defines a rear portion 35 of extended width providing a rear facing cavity 36 joined to a peripheral flange 37 extending transversely of the passageways 24, 24'. A front facing cavity 39 is formed in the flange to encircle the rear portion which cavity opens to the mating face and communicates laterally with the rearwardly facing cavity through a series of apertures 41 extending around the rear portion formed by the rear portion. The periphery of the flange 37 is formed at intervals with lands 44 formed with sockets 43 for receiving mounting bolts to secure the connector to the rim of a panel aperture (not shown).

The elastomeric seal 13 is a unitary structure extending through the apertures 41 into both the rear and front facing cavities 36, 39 respectively. The front facing portion of the seal is formed with a peripheral lip 45 and the portion of the seal within the rear cavity defines wire receiving extensions 47, 47' of restricted size of the passageways 24, 24' having resiliently compressible wire engaging lips 48, 48'. A relatively rigid wire supporting cap member 51 moulded of plastics is formed with a plurality of latching arms 52 on opposite sides which hook behind a surface 53 of the flange defining the found cavity with wire receiving bores 54, 54' formed in the cap aligned with the wire receiving passageways in the seal.

Each terminal 14 is stamped and formed from a single piece of sheet metal and comprises a contact portion 61 and a wire connecting portion 62. The contact portion includes a web 63 from a forward end in which extends a bifurcated tongue 64 reversely bent to overlie the web. Mounting flanges 65 upstand from opposite sides of the web and a rigid tongue 66 is pushed out from the underside of the web, a front facing free end 67 of which tongue provides a latching abutment for engagement with the shoulder 33 and a rear face 68 of which provides a cam surface for engagement with the nose of the latching arm, thereby facilitating insertion of the terminal into the housing. The wire connecting portion is formed with conventional conductor and insulation engaging crimping ferrules 69, 70, respectively.

Figure 4:
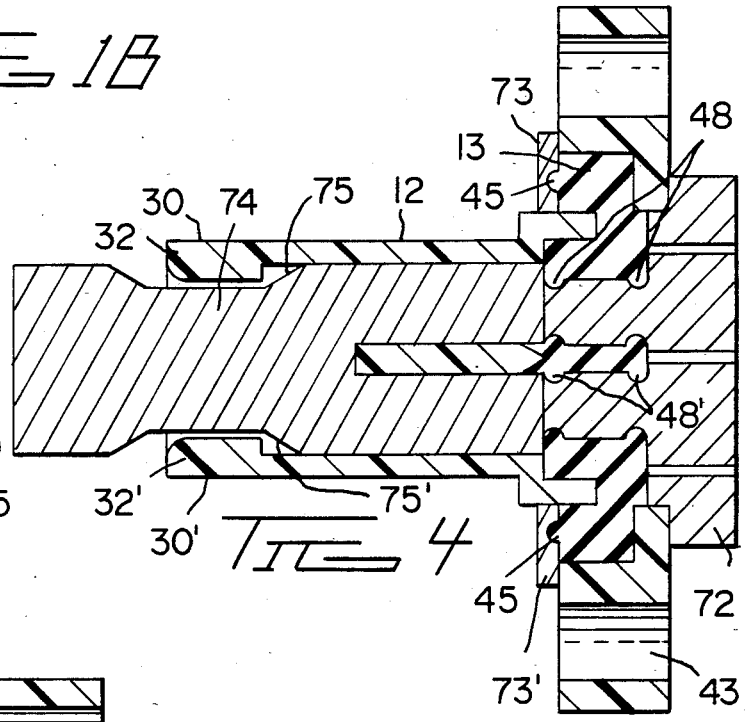
FIG. 4 is a view similar to FIG. 2A with the second stage moulding completed and prior to withdrawal of the moulded parts.
Figure 2A:
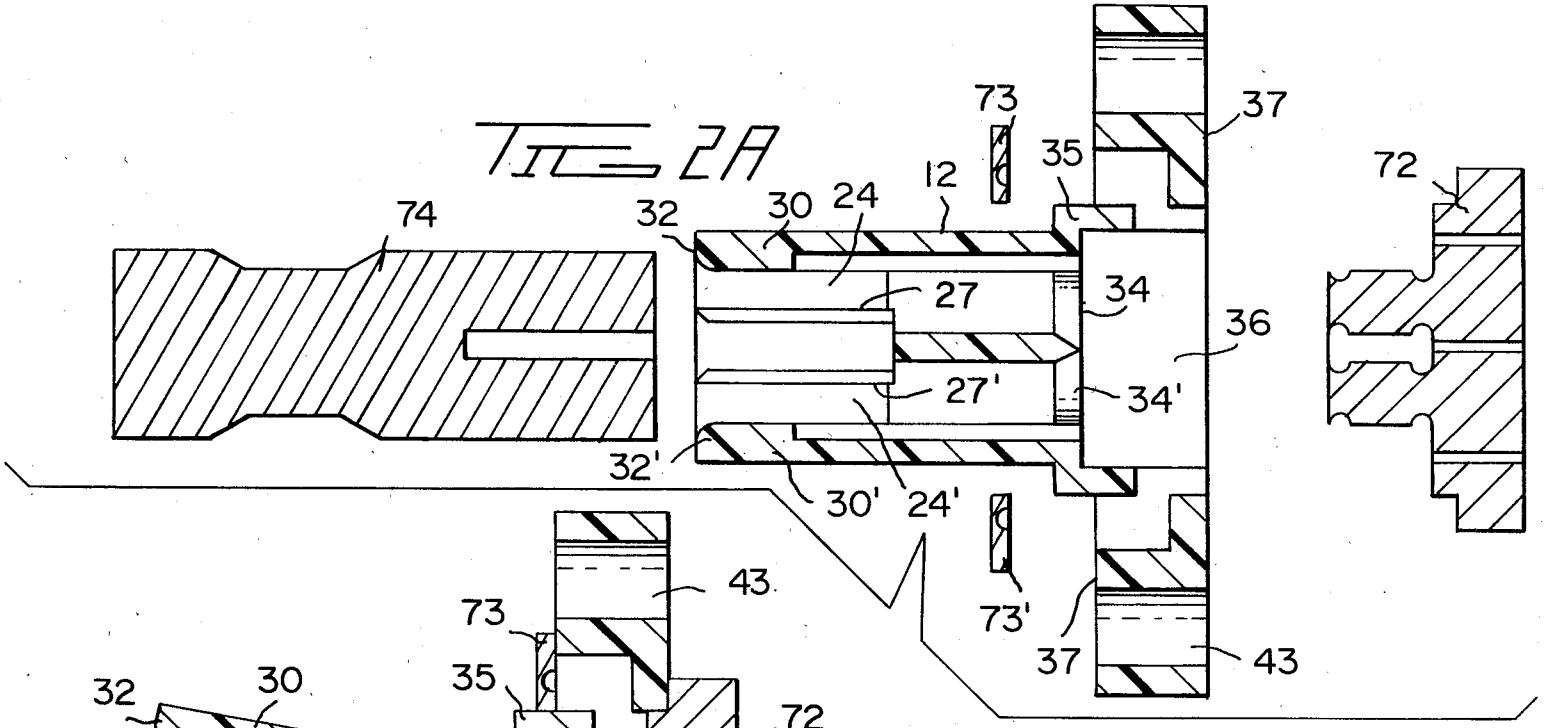
FIG. 2A is a cross-sectional view of a connector housing shell taken along line IIA—IIA in FIG. 1A with mould cores aligned for insertion therein for production of a second stage moulding.

According to the method of manufacturing and assembling the connector, the housing shell 12 (FIGS. 2A, 2B) is firstly moulded from a suitable plastics material such as a thermoplastic polyester. The shell 23 is then moved to a second moulding station where straight draw mould members 72, 73, 73', 74, have the configuration shown in FIG. 2A. On closing the mould, the mould core 74 is able to enter the terminal-receiving passageways by resilient flexure of the ends of the terminal latching fingers beyond an envelope defined by the imperforate wall portions of the passageways, as shown in FIG. 3. When fully inserted, the mould material is injected to form the seal as shown in FIG. 4. A suitable material is sold by Dow Corning, under part No. Q3-9591.

Figure 5:
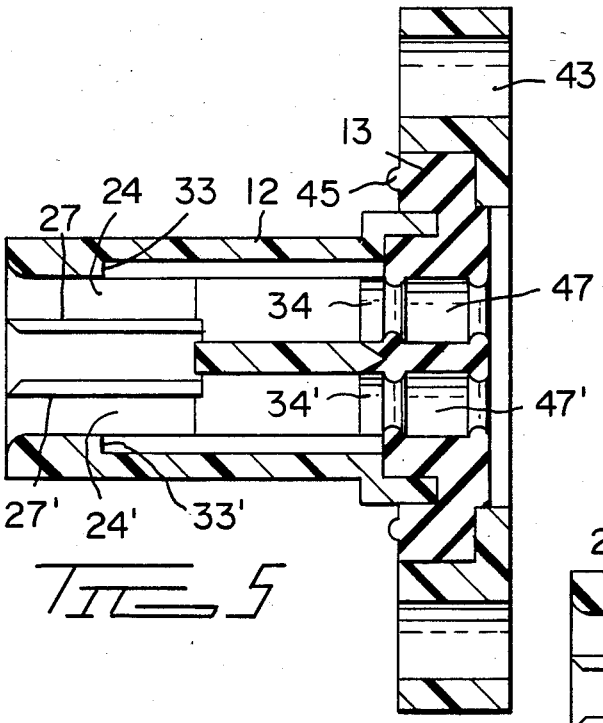
FIG. 5 is a view similar to FIG. 4 with the moulded parts withdrawn to release the connector housing.
Figure 6:
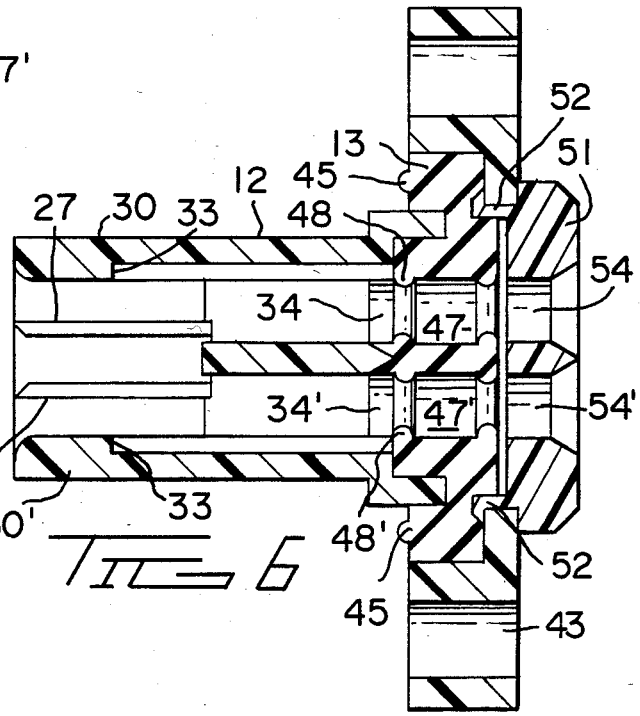
FIGS. 6–8B are views similar to FIG. 5 at various stages of assembly of the connector.

On release from the mould, facilitated by the provision of cam surfaces 75 on core 74, the housing shell 12 and in moulded seal 13 are as shown in FIG. 5.

Figure 7:
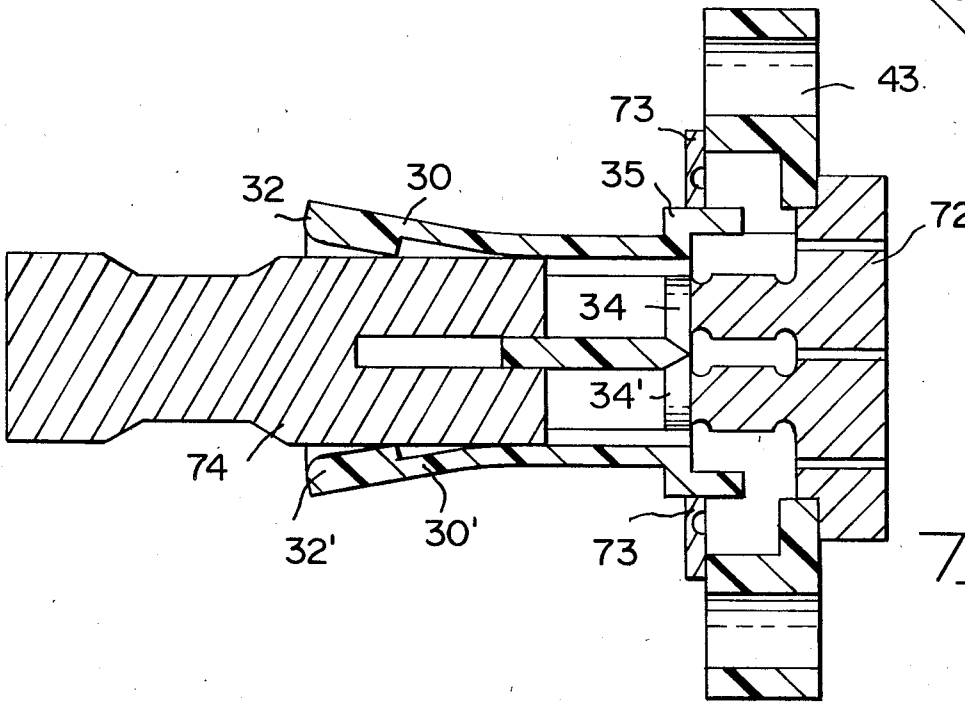
Figure 7:
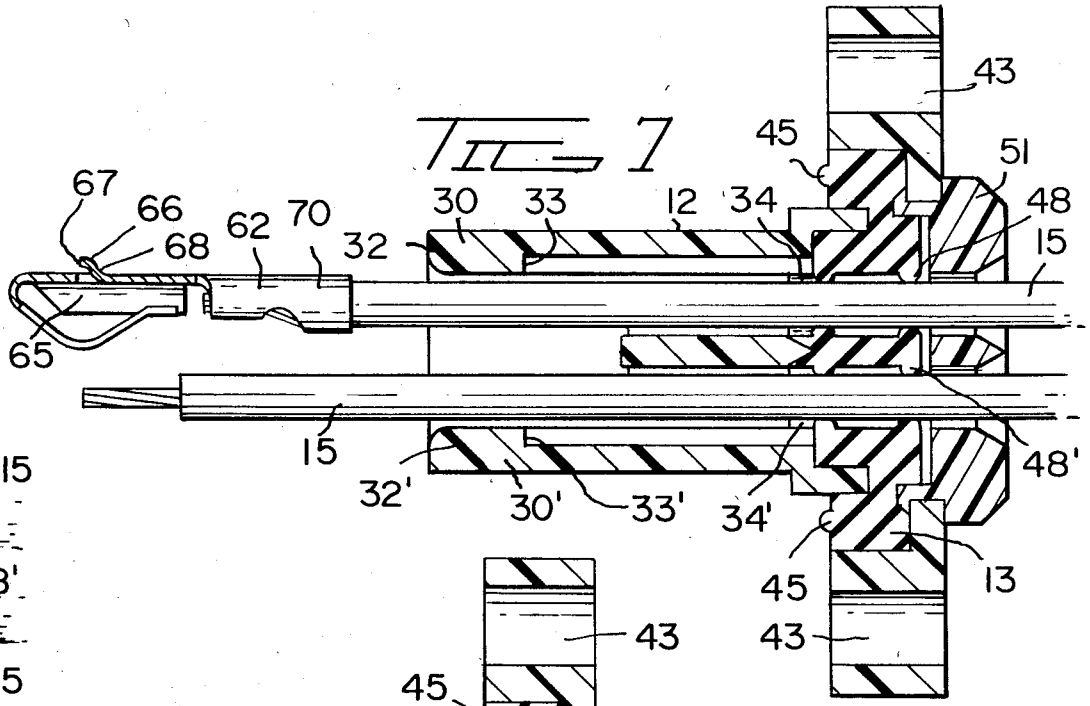
Figure 8A:
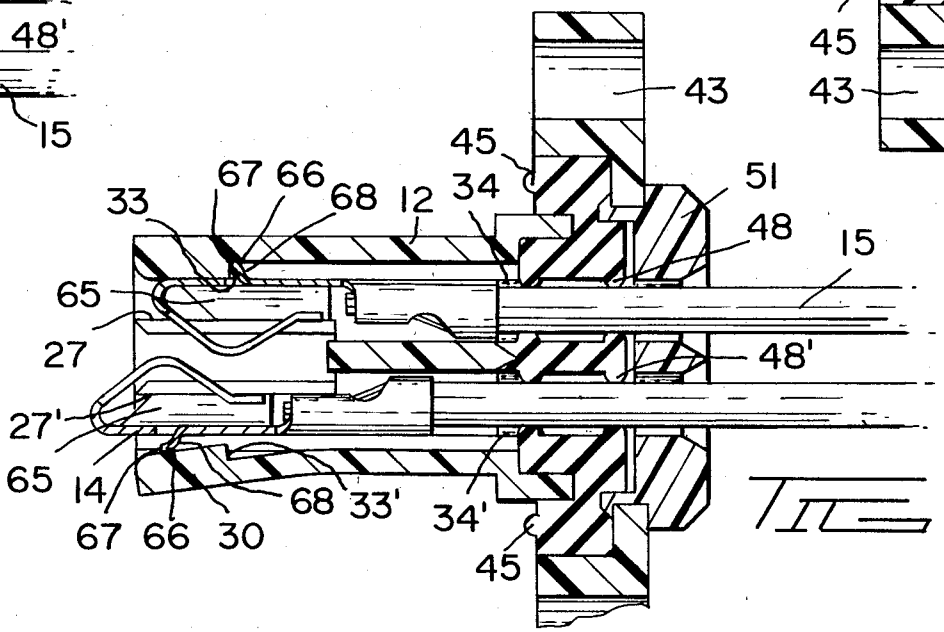
Figure 8B:
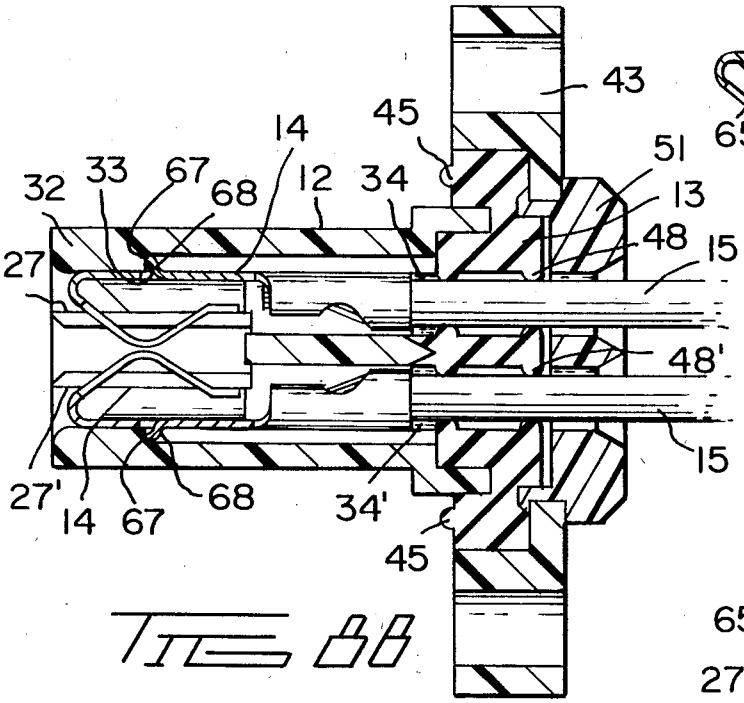

The cap 52 is then mounted on the flange 37 by forcing the latch arms 52 into the seal material 13 until they snap behind the surface 53. The successive steps of terminal assembly are shown in the upper and lower sections of FIGS. 7 and 8. Free ends of wires 15 are threaded through the cap 51, seal 13, and passageways 47, 47' and 24, 24' and terminated as shown in FIG. 7, the terminals 14 then being withdrawn into the passageways 24, 24'. As shown in FIG. 8, during withdrawal of a terminal 14 aided by the cam surface 68, the tongue 66 deflects the latching finger 30' out of the profile of the passageway and shell 12 and only after full insertion of the tongue, when the strain relief ferrule 70 is adjacent the annular constriction 34 or 34' will the latching arm resile back into the envelope, with the retention shoulder 33 or 33' aligned with the free end of the tongue. In consequence, the connector 11 cannot be inserted with a corresponding connector or panel aperture of close size until all terminals 12 are fully inserted into the passageways. The sealing member 13 cannot be damaged by the threading of only the wires therethrough while the cap 5 maintains the correct alignment of the wires preventing excessive seal distortion and consequential moisture penetration proximate the wires.

The flange can be bolted to a panel aperture with the lip 45 also sealing effectiveness against the rim of the aperture obviating risk of moisture ingress to the mating interface of the connector.

It will be appreciated that an individual terminal can be removed for replacement simply by outward flexure of the latching arm without need for a special tool and without disturbing the seal.

We claim:

1. An electrical connector housing comprising a shell defining walls of terminal receiving passageways communicating with a rear, wire receiving face and a front, mating face and elastomeric material moulded in a rear portion of the shell, the shell having a peripheral flange extending transversely of the rear portion and formed with a cavity opening to the mating face, the cavity and the rear portion intercommunicating, the elastomeric material in the cavity and in the rear portion constituting a unitary sealing member to provide wire receiving extensions of the passageways of restricted size for sealing engagement with the wires and to provide a seal surrounding the passageways.

2. An electrical connector housing according to claim 1 in which outer walls of the passageways are formed with resilient, axially extending, terminal latching fingers having free front ends and rearwardly facing terminal abutting shoulders for retention of the terminals in the passageways, the fingers being flexible beyond the profile of the housing to admit terminals into the passageways.

3. An electrical connector comprising a composite housing comprising a shell defining walls of terminal-receiving passageways communicating with a rear, wire receiving face and a front, mating face and elastomeric sealing material moulded in a rear portion of the shell, the shell having a peripheral flange extending transversely of the rear portion and formed with a cavity opening to the mating face, the cavity and the rear portion intercommunicating, the elastomeric sealing material in the cavity and in the rear portion constituting a unitary sealing member to provide wire receiving extensions of the passageways of restricted size for sealing engagement with the wires and to provide a seal surrounding the passageways.

4. An electrical connector according to claim 3 in which outer walls of the passageways are formed with resilient, axially extending, terminal latching fingers having free front ends and rearwardly facing terminal abutting shoulders for retention of the terminals in the passageways, the fingers being flexible beyond the profile of the housing to admit terminals into the passageways.

5. An electrical connector according to claim 4 in which each terminal is formed with a rigid tongue having a front facing free end aligned with the shoulders.

* * * * *